United States Patent [19]

Diefenbach et al.

[11] Patent Number: 4,606,121

[45] Date of Patent: Aug. 19, 1986

[54] DRIVE MECHANISM FOR A VIBRATION-TYPE DRY-SHAVER

[75] Inventors: Gerhard Diefenbach, Aachen, Fed. Rep. of Germany; Hugo Schemmann, Schaesberg, Netherlands; Romuald L. Bukoschek, Klagenfurt, Austria

[73] Assignee: U.S. Philips Corporation, New York, N.Y.

[21] Appl. No.: 698,002

[22] Filed: Feb. 4, 1985

[30] Foreign Application Priority Data

Feb. 8, 1984 [DE] Fed. Rep. of Germany ..... 3404296

[51] Int. Cl.[4] ..... B26B 19/02

[52] U.S. Cl. ..... 30/43.92; 30/219

[58] Field of Search ..... 30/219, 43.92

[56] References Cited

U.S. PATENT DOCUMENTS

| | | | |
|---|---|---|---|
| 2,203,021 | 6/1940 | Jones | 30/43.92 |
| 2,287,686 | 6/1942 | Jones | 30/43.92 |
| 3,714,711 | 2/1973 | Daniels | 30/43.92 |
| 4,312,126 | 1/1982 | Rochelt | 30/43.92 |
| 4,400,875 | 8/1983 | Buzzi | 30/43.92 |

FOREIGN PATENT DOCUMENTS

| | | | |
|---|---|---|---|
| 825518 | 12/1959 | United Kingdom | 30/43.92 |
| 1435456 | 5/1976 | United Kingdom | 30/43.92 |

*Primary Examiner*—Jimmy C. Peters

*Attorney, Agent, or Firm*—Rolf E. Schneider

[57] ABSTRACT

A drive mechanism for a dry shaver comprising a shear foil and a cutter reciprocatory relative to the shear foil includes a single-phase synchronous motor having a drive shaft. A cam is mounted on the drive shaft, and a transmission roller is constantly in contact with the cam. The surface of at least one of the cam and the transmission roller is provided with a layer approximately 1 mm in thickness of an elastic material.

5 Claims, 1 Drawing Figure

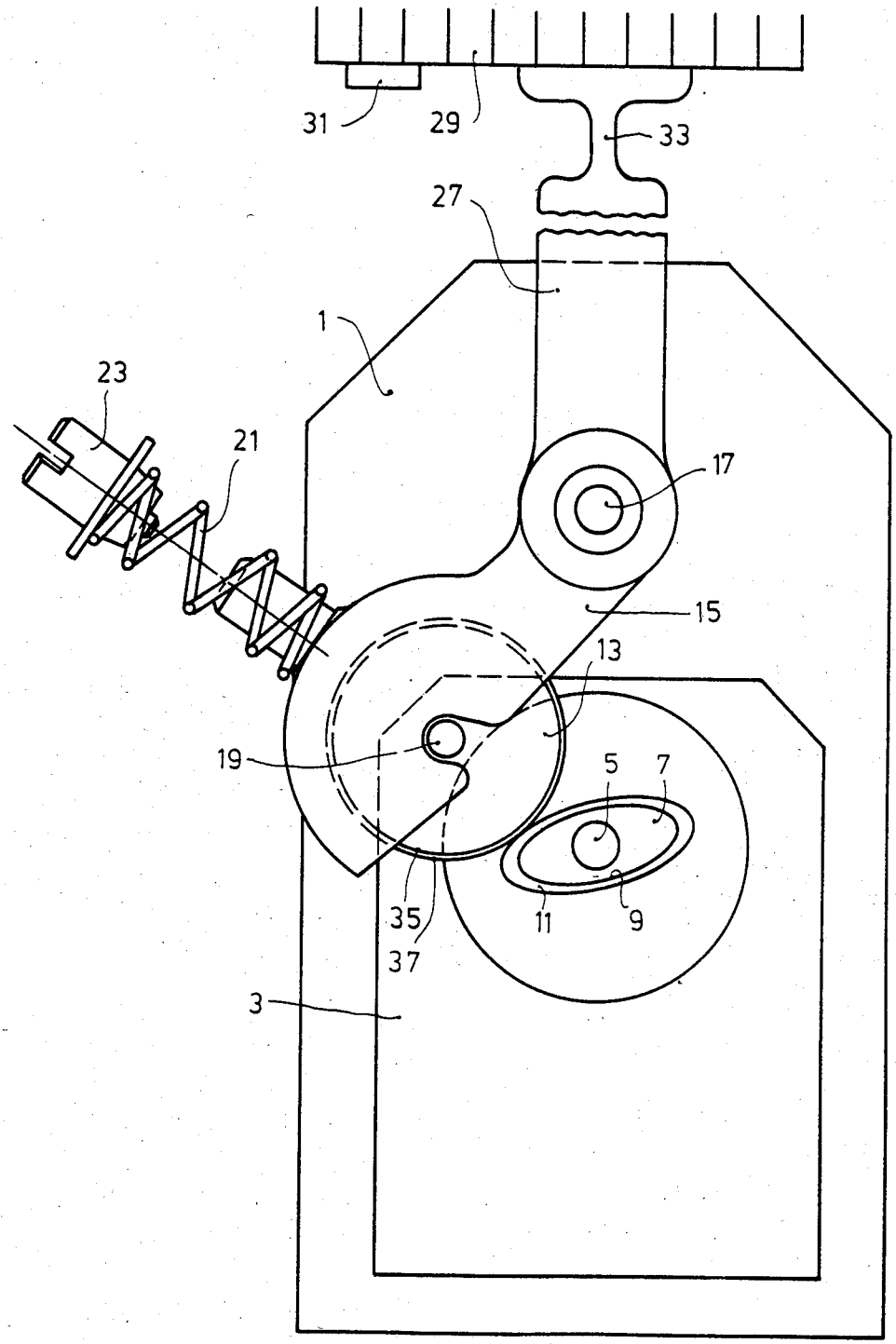
31
29
33
27
1
23
21
17
15
13
19
5
7
35
37
11
9
3

DRIVE MECHANISM FOR A VIBRATION-TYPE DRY-SHAVER

This invention relates to a drive-mechanism for a dry-shaver comprising a shear foil and a cutter which is reciprocatory relative to the shear foil by means of a single-phase synchronous motor, the motion of the motor shaft being transmitted to the cutter by means of a cam mounted on the shaft and a transmission roller which is constantly in contact with the cam (U.S. Pat. No. 4,400,875).

When such a shaver is driven by means of a single-phase synchronous motor this has the advantage that the shaver dimensions can be smaller. In addition, a rotry motor produces less noise than a vibrating-armature motor.

However, synchronous motors have also specific disadvantages which manifest themselves when such motors are used for driving electric shavers. In particular, instabilities in speed may occur under operating conditions. Such instabilities may adversely affect the shaving result, as in the case of a vibration type drive system and may lead to excessive wear and a higher noise level.

It is the object of the present invention to stabilize the operation of a single-phase synchronous motor used for driving such a shaving cutter thereby improving the shaving result and in particular, reducing the wear and the noise level.

According to the invention this is achieved in that at least the surface of the transmission roller and/or the cam is made of an elastic material.

Surprisingly, it has been found that the use of an elastic material in the transmission path between the cam and the transmission roller stabilizes the motor operation to such an extent that instabilities in speed disappear and a quiet and steady drive is obtained. It also leads to an improved shaving result.

In a further embodiment of the invention the elastic material is arranged on the surface of the transmission roller and/or the cam as a layer. This elastic material layer may be an elastic rubber layer having a thickness of, for example, approximately 1 mm.

The invention will now be described in more detail, with reference to the accompanying drawing, the diagrammatic showing of the single FIGURE illustrating the present cam-transmission roller arrangement.

The drawing shows a wall 1 of a dry-shaver to which a synchronous motor 3 is secured. The drive shaft 5 of the synchronous motor extends perpendicularly to the plane of the drawing. The drive shaft 5 carries a cam 7 whose circumferential surface 9 is coated with a rubber layer 11 of approximately 1 mm thickness.

The cam cooperates with a transmission roller 13 which is mounted in a lever 15. The lever 15 can pivot about a spindle 17. Near the roller spindle 19 the lever 15 cooperates with a spring 21 whose pre-load is adjustable by means of a set-screw 23.

The lever 15 is connected to a reciprocatory cutter 29 of a vibration-type shaver via a portion 27, the cutter being guided by supports 31. A pivot, which is not described in more detail, for example an integral hinge 33, provides the non-rigid connection between the cutter 29 and the member 27.

The surface 35 of the roller 13 may be provided with a rubber layer 37 of approximately 1 mm thickness. Alternatively, either the cam 7 or the transmission roller may be provided with the rubber layer. Moreover, it is possible to manufacture the entire cam and the entire transmission roller of rubber or another elastic material.

What is claimed is:

1. A drive mechanism for a dry shaver comprising a shear foil and a cutter reciprocatory relative to the shear foil, which includes a single-phase synchronous motor having a drive shaft; a cam mounted on said drive shaft; and a transmission roller constantly in contact with said cam; the surface of at least one of said cam and said transmission roller being provided with a layer approximately 1 mm in thickness of an elastic material.

2. A drive mechanism according to claim 1, in which the elastic material layer is provided on the cam.

3. A drive mechanism according to claim 1, in which the elastic material layer is provided on the transmission roller.

4. A drive mechanism according to claim 1, in which each of the cam and the transmission roller is provided with the elastic material layer.

5. A drive mechanism according to claim 1, in which the elastic material is an elastic rubber.

* * * * *